US009748629B2

(12) United States Patent
Velez et al.

(10) Patent No.: US 9,748,629 B2
(45) Date of Patent: Aug. 29, 2017

(54) TROPOSCATTER ANTENNA POINTING

(71) Applicant: TeleCommunication Systems, Inc., Annapolis, MD (US)

(72) Inventors: Alexie Velez, Tampa, FL (US); Robert D. McCarley, Tampa, FL (US); Fred William Rieck, Lithia, FL (US); Douglas B. Houston, Riverview, FL (US)

(73) Assignee: Telecommunication Systems, Inc., Annapolis, MD (US)

( * ) Notice: Subject to any disclaimer, the term of this patent is extended or adjusted under 35 U.S.C. 154(b) by 114 days.

(21) Appl. No.: 14/836,118

(22) Filed: Aug. 26, 2015

(65) Prior Publication Data

US 2017/0062900 A1 Mar. 2, 2017

(51) Int. Cl.
*H01Q 1/12* (2006.01)

(52) U.S. Cl.
CPC ..... *H01Q 1/125* (2013.01)

(58) Field of Classification Search
CPC ..... H01Q 1/125
See application file for complete search history.

(56) References Cited

U.S. PATENT DOCUMENTS 5,629,709 A * 5/1997 Yamashita ..... H01Q 1/1257 342/359
6,377,211 B1 * 4/2002 Hsiung ..... H01Q 1/3275 342/359
7,711,030 B2 * 5/2010 Perlman ..... H04B 7/0684 370/278
2008/0297425 A1 * 12/2008 Axton ..... H01Q 1/125 343/761

OTHER PUBLICATIONS

Comtech Systems, Inc., Shipboard Troposcatter Tactical Maritime Communications Solutions for Littoral Environments, Jun. 30, 2015, 1-56, Department of the Navy, United State of America.
Comtech Systems, Inc., Advanced Troposcatter Communications Products, Mar. 12, 2009, 1-3, Comtech Systems, Inc., Orlando, Florida.

* cited by examiner

*Primary Examiner* — Trinh Dinh
(74) *Attorney, Agent, or Firm* — Tarolli, Sundheim, Covell & Tummino LLP

(57) ABSTRACT

A troposcatter terminal can include a location receiver, a network interface, an antenna control unit, and a motor controller. The location receiver can be configured to receive first current location information associated with a local troposcatter antenna. The network interface can be configured to receive second current location information associated with a distant troposcatter antenna. The antenna control unit can be configured to determine a heading from the local troposcatter antenna to the distant troposcatter antenna, an azimuth angle for the local troposcatter antenna, and an elevation angle for the local troposcatter antenna, the heading, the azimuth angle, and the elevation angle based on the first location information and the second location information. The motor controller can be configured to point the local troposcatter antenna according to the heading, the azimuth angle, and the elevation angle to establish troposcatter communications between the local troposcatter antenna and the distant troposcatter antenna.

20 Claims, 4 Drawing Sheets

TROPOSCATTER ANTENNA POINTING

BACKGROUND

1. Field

The present disclosure is directed toward a method and apparatus for pointing troposcatter antennas. More particularly, the present disclosure is directed toward exchanging location information between user terminals as a basis to point troposcatter antennas at each other.

2. Introduction

Troposcatter communications use the lower atmosphere, or troposphere, as a basis to establish communications between troposcatter terminals. These communications go beyond traditional line of sight communications, which are limited to certain distances because of the curvature of the earth. In addition, line of sight communications can be degraded or blocked by structures or other barriers, for example, mountains, hills, etc. Troposcatter communications utilize these barriers as an advantage by diffracting the troposcatter signals over these barriers and bounce a signal off of the troposphere, thus improving communications. For military applications, troposcatter communications sites are established with pre-determined locations based on a specific mission, to extend communications to distant sites that extend beyond the main operations centers.

Presently, operators are used to point troposcatter antennas. An operator, using previous knowledge of approximate latitude and longitude location of a distant end terminal, manually points their troposcatter antenna in the general direction of the distant end terminal to begin working a communications link. This manual operator process is very slow. For example, an operator takes from 1 hour to days to manually establish a communications link using an AN/TRC-170.

SUMMARY OF THE EMBODIMENTS

A troposcatter terminal can include a location receiver, a network interface, an antenna control unit, and a motor controller. The location receiver can be configured to receive first current location information associated with a local troposcatter antenna. The network interface can be configured to receive second current location information associated with a distant troposcatter antenna. The antenna control unit can be configured to determine a heading from the local troposcatter antenna to the distant troposcatter antenna, an azimuth angle for the local troposcatter antenna, and an elevation angle for the local troposcatter antenna, the heading, the azimuth angle, and the elevation angle based on the first location information and the second location information. The motor controller can be configured to point the local troposcatter antenna according to the heading, the azimuth angle, and the elevation angle to establish troposcatter communications between the local troposcatter antenna and the distant troposcatter antenna.

A method to establish troposcatter communications can include: receiving, with a location receiver, first current location information associated with a local troposcatter antenna; receiving, with a network interface, second current location information associated with a distant troposcatter antenna; determining, with an antenna control unit, a heading from the local troposcatter antenna to the distant troposcatter antenna, an azimuth angle for the local troposcatter antenna, and an elevation angle for the local troposcatter antenna, the heading, the azimuth angle, and the elevation angle based on the first location information and the second location information; and pointing, with a motor controller, the local troposcatter antenna according to the heading, the azimuth angle, and the elevation angle to establish the troposcatter communications between the local troposcatter antenna and the distant troposcatter antenna.

BRIEF DESCRIPTION OF THE DRAWINGS

In order to describe the manner in which advantages and features of the disclosure can be obtained, a description of the disclosure is rendered by reference to specific embodiments thereof which are illustrated in the appended drawings. These drawings depict only example embodiments of the disclosure and are not therefore to be considered to be limiting of its scope.

DETAILED DESCRIPTION

What is needed is a troposcatter communication system that allows for one or both of antennas within the troposcatter communication system to be in motion (Communications on the Move (COTM)) while maintaining troposcatter communications. Current location information (for example, latitude/longitude) for the antennas can be exchanged between user terminals of the troposcatter communication system. This current location information can be used by each user terminal to coordinate pointing angles toward one another. The troposcatter communication system can update antenna pointing based a change in heading or geographic location. Such updating and compensation allows the troposcatter communication system to maintain communications, even when one or both of the antennas are in motion. Such a troposcatter communication system overcomes the shortcomings of present troposcatter communication system, while being able to be operational in less than 30 minutes.

Figure 1:
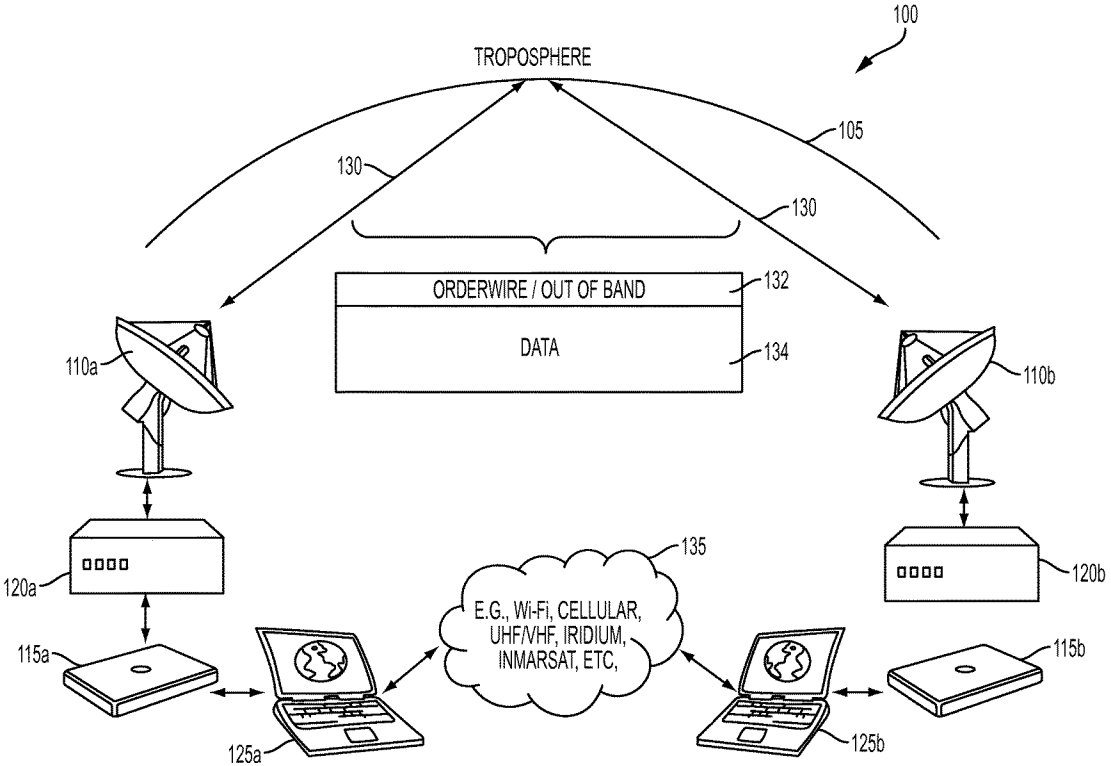
FIG. 1 is a block diagram of an example troposcatter communication system, according to one or more embodiments.

FIG. 1 is a block diagram of an example troposcatter communication system 100, according to one or more embodiments. The troposcatter communication system 100 can include first and second troposcatter antenna 110*a* and 110*b*, first and second high power amplifiers 120*a* and 120*b* coupled to the first and second antenna 110*a* and 110*b*, respectively, and also coupled to first and second modems 115*a* and 115*b*, respectively, the first and second modems 115*a* and 115*b* also coupled to the first and second user terminals 125*a* and 125*b*, respectively. In one or more embodiments, the first and second user terminals 125*a* and 125*b* can be coupled through a communication medium 135.

The first and second antennas 110*a* and 110*b* can be pointed at each other to allow the first and second user terminals 125*a* and 125*b* to establish troposcatter communications 130 with one another. The first and second antennas 110*a* and 110*b* can be pointed at headings that correspond to a straight line between the first and second antennas 110*a* and 110*b*. The first and second antennas 110*a* and 110*b* can be pointed at the troposphere 105 at an azimuth angle and an elevation angle. Such an azimuth angle and an elevation angle can be calculated to bounce a signal off of the troposphere 105 to establish troposcatter communications 130 between the first and second user terminals 125*a* and 125*b* using the first and second antennas 110*a* and 110*b*, respectively.

The first and second antennas 110*a* and 110*b* can establish point-to-point troposcatter communications 130 (for example, an Ethernet pipe). In one or more embodiments, the troposcatter communications 130 can include up to thirty-two (32) data channels. A single channel of the thirty-two data channels can provide communications at 64 kilo bits-per-second (kbps), with thirty-two data channels providing a throughput of 2048 kbps. Each channel of the troposcatter communications 130 can include transmission of an orderwire/out of band portion 132 and a data portion 134. The first and second user terminals 125*a* and 125*b* can use the orderwire/out of band portion 132 and/or the data portion 134 to exchange location information. As described herein, the first antenna 110*a* is a local antenna and the second antenna 110*b* is a distant antenna from a perspective of the first user terminal 125*a*, the first power amplifier 120*a* and the first modem 110*a*. Additionally, in this same manner, the second antenna 110*b* is a local antenna and the first antenna 110*a* is a distant antenna from a perspective of the second user terminal 125*b*, the second power amplifier 120*b* and the second modem 110*b*. The first and second antennas 110*a* and 110*b* can have characteristics including: communication frequencies ranging from 1.7 MHz to 8 GHz, communicate over a path length ranging from 40 to 300 Km dependent on frequency and path selected, communicate at power ranging from 10 to 10,000 Watts, receive noise ranging from ≤1.9 dB to ≤3.5 dB, either dual or quad diversity, having an antenna length of 1.2 to 9.1 m based on frequency, establish communications having a bit error rate of ≤106, and/or maintain a link availability of 99.9%. In one or more embodiments, the first antenna 110*a* and/or the second antenna 110*b* can be a 2.4 m TeleCommunication Systems, Inc. antenna.

The first and second modems 115*a* and 115*b* can receive/pass signals from/to the first and second user terminals 125*a* and 125*b*, respectively. The first and second modems 115*a* and 115*b* can receive/pass signals from/to the first and second high power amplifiers 120*a* and 120*b*, respectively. The first and second modems 115*a* and 115*b* can demodulate a signal produced by the first and second high power amplifiers 120*a* and 120*b*, respectively. The first and second modems 115*a* and 115*b* can modulate a signal produced by the first and second user terminals 125*a* and 125*b*, respectively. In one or more embodiments, the first and second modems 115*a* and 115*b* can be Comtech System, Inc. CS67500A modems providing up to 50 Mbps throughput.

The first and second high power amplifiers 120*a* and 120*b* can receive/pass signals from/to the first and second modems 115*a* and 115*b*, respectively. The first and second high power amplifiers 120*a* and 120*b* can receive/pass signals from/to the first and second antenna 110*a* and 110*b*, respectively. The first and second high power amplifiers 120*a* and 120*b* can operate with a power range of approximately 10 W to 10 kW.

The first and second modems 115*a* and 115*b* can, once troposcatter communications 130 are established between the first and second antennas 110*a* and 110*b*, share diagnostic information with each other. The first and second modems 115*a* and 115*b* can share this diagnostic information through the orderwire/out of band portion 132 of the troposcatter communications 130. In one or more embodiments, the first and second modems 115*a* and 115*b* can also use the orderwire/out of band portion 132 to establish a chat service for operators of the first and second user terminals 125*a* and 125*b* to be able to communicate with one another.

The first and second user terminals 125*a* and 125*b* can each receive location information (for example, latitude/longitude coordinates) and transmit location information. For example, the first user terminal 125*a* can receive location information indicating a current location of the second antenna 110*b*, and the second user terminal 125*b* can receive location information indicating a current location of the first antenna 110*a*. Likewise, the first user terminal 125*a* can transmit location information indicating a current location of the first antenna 110*a*, and the second user terminal 125*b* can transmit location information indicating a current location of the second antenna 110*b*. The first and second user terminals 125*a* and 125*b* can use the received location information as a basis to point the first and second antennas 110*a* and 110*b* at each other, respectively.

The first and second user terminals 125*a* and 125*b* can determine a heading between the first and second antennas 110*a* and 110*b*, respectively, based on a current location of the first and second antenna 110*a* and 110*b*. The first and second user terminals 125*a* and 125*b* can determine optimal azimuth and elevation angles that are needed to bounce a signal off of the troposphere 105 to allow the first and second user terminals 125*a* and 125*b* to establish troposcatter communicates 130 with each other. Such optimal azimuth and elevation angles maximizes data throughput between the first and second user terminals 125*a* and 125*b*.

Each of the first and second user terminals 125*a* and 125*b* can have a unique identifier (for example, System ID). These unique identifiers can be assigned in a specific network and stored in memories of the first and second user terminals 125*a* and 125*b*. Based on network configuration and pre-planning, the first and second user terminals 125*a* and 125*b* can be pre-configured to "look" for a unique identifier. The first user terminal 125*a* can analyze received data to determine if a unique identifier for the second user terminal 125*b* is included in the received data, and vise versa. If the proper unique identifier is included with the received data, the first and second user terminals 125*a* and 125*b* can analyze the received data to determine location information associated with the unique identifier. The first and second user terminals 125*a* and 125*b* can use the location information associated with the unique identifier as a basis to point the first and second antennas 110*a* and 110*b*, respectively.

Figure 2:
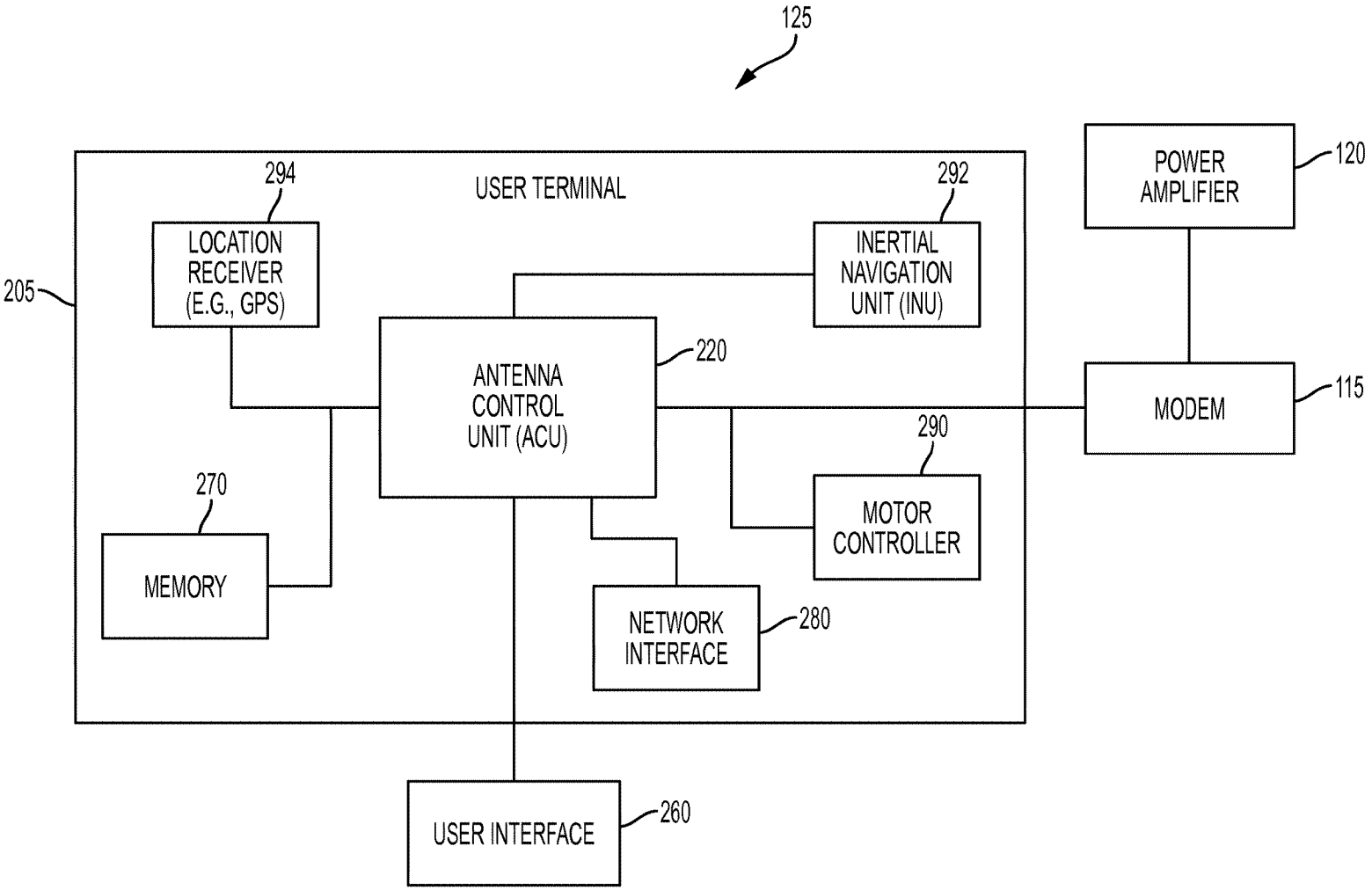
FIG. 2 illustrates a block diagram of an example user terminal, according to one or more embodiments.

FIG. 2 illustrates a block diagram of an example user terminal 125, according to one or more embodiments. The user terminal 125 can be a wireless terminal, a portable wireless communication device, a smartphone, a cellular telephone, a flip phone, a personal digital assistant, a personal computer, a tablet computer, or any other user terminal 125 that can be used to establish troposcatter communications 130.

The user terminal 125 can include a housing 205, an antenna control unit (ACU) 220 within the housing 205, audio input and output circuitry (not shown) coupled to the ACU 220, a user interface 260 coupled to the ACU 220, a memory 270 coupled to the ACU 220, and a network interface 280 coupled to the ACU 220. The user terminal 125 can further include the motor controller 290 coupled to the ACU 220, an inertial navigation unit (INU) 292 coupled to the ACU 220, and a location receiver 294 coupled to the ACU 220. The apparatus 125 can perform the methods described in all the embodiments.

The user interface 260 can include a viewfinder, a liquid crystal display (LCD), a light emitting diode (LED) display, a plasma display, a projection display, a touch screen, or any other device that displays information. The user interface 260 can further include a keypad, a keyboard, buttons, a touch pad, a joystick, another additional display, or any other device useful for providing an interface between a user and an electronic device. The network interface 280 can include a transmitter and/or a receiver. The audio input and output circuitry can include a microphone, a speaker, a transducer, or any other audio input and output circuitry. The memory 270 can include a random access memory, a read only memory, an optical memory, a flash memory, a removable memory, a hard drive, a cache, or any other memory that can be coupled to the user terminal 125.

The user terminal 125 or the ACU 220 may implement any operating system, such as Microsoft Windows®, UNIX®, or LINUX®, Android™, or any other operating system. Apparatus operation software may be written in any programming language, such as C, C++, Java or Visual Basic, for example. Apparatus software may also run on an application framework, such as, for example, a Java® framework, a .NET® framework, or any other application framework. The software and/or the operating system may be stored in the memory 270 or elsewhere on the user terminal 125. The user terminal 125 or the ACU 220 may also use hardware to implement disclosed operations. For example, the ACU 220 may be any programmable processor. Disclosed embodiments may also be implemented on a general-purpose or a special purpose computer, a programmed microprocessor or microprocessor, peripheral integrated circuit elements, an application-specific integrated circuit or other integrated circuits, hardware/electronic logic circuits, such as a discrete element circuit, a programmable logic device, such as a programmable logic array, field programmable gate-array, or the like. In general, the ACU 220 may be any controller or processor device or devices capable of operating an electronic device and implementing the disclosed embodiments.

The network interface 280 can be a universal serial bus port, or any other interface that can connect an apparatus to a network or computer and that can transmit and receive data communication signals. The network interface 280 can be a wired communication interface, such as a universal serial bus interface, an Ethernet port, an infrared transmitter/receiver, an IEEE 1394 port, a serial wired interface, a parallel wired interface, an Ethernet interface, or other wired interface, can be an optical interface, such as an infrared interface, can be a wireless interface, such as a Bluetooth® interface, a Wi-Fi interface, a wireless local area network interface, a cellular network interface, a satellite network interface (for example, cubesat), a wireless Wide Area Network (WAN) interface, a Ultra High Frequency (UHF)/Very High Frequency (VHF) interface, a Blueforce Tracking interface, a Broadband Global Area Network (BGAN) interface, a troposcatter interface to establish troposcatter communications 130, an Iridium interface, an Inmarsat interface, and/or can be any other interface or combination of interfaces that allows the first and second user terminals 125*a* and 125*b* to communicate with one another. The user terminals 125*a* and 125*b* can use the network interface 280 to communicate location information, unique identifier, and/or any other information that can be used to point the first and second antennas 110*a* and 110*b* or any information operators of the first and second user terminals 125*a* and 125*b* desire to be communicated between the first and second user terminals 125*a* and 125*b*.

The first and second user terminals 125*a* and 125*b* can establish minimal communications via the troposcatter communications 130 to exchange initial current location information. For example, the first and second antennas 110*a* and 110*b* can be pointed at each other based on rough approximations of locations of the first and second antennas 110*a* and 110*b*. The first and second antennas 110*a* and 110*b* can be moved to pre-designated locations having known approximate latitudes and longitudes, respectively. Such rough pointing of the first and second antennas 110*a* and 110*b* can allow the first and second user terminals 125*a* and 125*b* to exchange small amounts of data (for example, a few bytes) needed to exchange unique identifier and initial current location information. Once such initial location information is exchanged between the first and second user terminals 125*a* and 125*b*, such initial current location information can be used by the first and second user terminals 125*a* and 125*b* to accurately point the first and second antennas 110*a* and 110*b* to optimize communications between the first and second user terminals 125*a* and 125*b*. Thereafter, the first and second user terminals 125*a* and 125*b* can continue to and/or periodically exchange current location information via the troposcatter communications 130 to maintain optimized pointing of the first and second antennas 110*a* and 110*b*. Such initial exchange of current location information between the first and second user terminals 125*a* and 125*b* can be performed via any communications available to the first and second user terminals 125*a* and 125*b*, via the network interface 280.

In one or more embodiments, when the first and second user terminals 125*a* and 125*b* are unable to exchange initial location information via the troposcatter communications 130, the first and second user terminals 125*a* and 125*b* can broadcast a unique identifier and initial current location information via the communication medium 135. In one or more embodiments, the communication medium 135 can be a low bandwidth, high latency communication medium. In one or more embodiments, the communication medium 135 can be a high bandwidth, low latency communication medium. The first and second user terminals 125*a* and 125*b* can exchange initial current location information via communication medium 135 as a basis to initially point the first and second antennas 110*a* and 110*b*. Once the first and second antennas 110*a* and 110*b* have been initially pointed toward each other, the first and second user terminals 125*a* and 125*b* can, via the high power amplifiers 120*a* and 120*b* and the first and second modems 115*a* and 115*b*, establish troposcatter communications 130 via the first and second antennas 110*a* and 110*b*. Once the troposcatter communications 130 are established via the first and second antennas 110*a* and 110*b*, the first and second user terminals 125*a* and 125*b* can use a portion of the bandwidth of the troposcatter communications 130 to exchange current location information with each other in order to maintain pointing accuracy of the first and second antennas 110*a* and 110*b*.

In one or more embodiments, the first and second user terminals 125*a* and 125*b* can broadcast a unique identifier and attempt to exchange initial current location information via the troposcatter communications 130. If the attempt to exchange initial location information using the troposcatter communications 130 fails, the first and second user terminals 125*a* and 125*b* can switch to communication medium 135 as a basis for exchanging the initial location information. Likewise, if the attempt to exchange initial location information using the communication medium 135 fails, the first and second user terminals 125*a* and 125*b* can switch to the troposcatter communications 130 as a basis for exchanging the initial current location information. In one or more embodiments, the first and second user terminals 125*a* and

125*b* can broadcast a unique identifier and attempt to exchange initial location information simultaneously via the troposcatter communications 130 and the communication medium 135. Irrespectively of which of the troposcatter communications 130 and the communication medium 135 the first and second user terminals 125*a* and 125*b* are able to communicate the unique identifier and initial location information, the first and second user terminals 125*a* and 125*b* can point the first and second antennas 110*a* and 110*b*, respectively, at each other to begin communications via troposcatter communications 130. Thereafter, the first and second user terminals 125*a* and 125*b* can continue to exchange current location information via the troposcatter communications 130 as a basis for maintaining optimal pointing of the first and second antennas 110*a* and 110*b*.

In one or more embodiments, operators of the first and second user terminals 125*a* and 125*b* can use the troposcatter communications 130 and/or the communication medium 135 as a basis to verbally communicate with each other. The operators can verbally exchange current location information. This verbally exchanged location information can be manually entered into the first and second user terminals 125*a* and 125*b* as a basis to initially point the first and second antennas 110*a* and 110*b*. Thereafter, the first and second user terminals 125*a* and 125*b* can automatically exchange current location information as a basis for maintaining optimal pointing of the first and second antennas 110*a* and 110*b*.

The ACU 220 can determine a heading between the first and second user antennas 110*a* and 110*b*, and an azimuth angle and an elevation angle. The first and second antennas 110*a* and 110*b* can be pointed according to the heading, the azimuth angle and the elevation angle as a basis to bounce a signal off of the troposphere 105 to establish troposcatter communications 130 between the first and second user terminals 125*a* and 125*b*. For example, the ACU 220 of the first user terminal 125*a* can determine a heading to the second user terminal 125*b* and the azimuth and the elevation angles using a current location of the first user terminal 125*a* and received current location of the second user terminal 125*b*. Likewise, the ACU 220 of the second user terminal 125*b* can determine a heading to the first user terminal 125*a* and the azimuth and the elevation angles using a current location of the second user terminal 125*b* and received current location of the first user terminal 125*a*.

The INU 292 can determine inertial information for an antenna associated with the user terminal 125. The inertial information can include roll, pitch, and/or yaw associated with the antenna. For example, the INU 292 of the first user device 125*a* can determine inertial information for antenna 110*a* and the INU 292 of the second user device 125*b* can determine inertial information for antenna 110*b*. In one or more embodiments in which the first user terminal 125*a* or the second user terminal 125*b* is stationary and not experiencing inertial forces, the first user terminal 125*a* or the second user terminal 125*b* can eliminate the INU 292. The INU 292 may include a gyroscope, a gyrostat, a microelectromechanical system gyroscope, a fiber optic gyroscope, a ring laser gyroscope, a hemispherical resonator gyroscope, or any other device that can determine inertial forces acting on the antenna.

The location receiver 294 can receive signals indicating a current location of the antenna or can receive signals that can be used to determine a current location of the antenna. The location receiver 294 can be located proximate to the antenna such that location information produced by the location receiver 294 corresponds to the location of the antenna. The location receiver 294 can be a Global Positioning System (GPS) receiver, Differential GPS receiver, a Dynamic positioning (DP) receiver, an acoustic positioning receiver, an Inertial Navigation Unit, a GLObal NAvigation Satellite System (GLONASS) receiver, Selective Availability Anti-spoofing Module (SAASM), celestial navigation, and/or any other receiver that allows the user terminal 125 to determine a current location information for the antenna. In one or more embodiments, the location receiver 294 can be the network interface 280, with the network interface 280 receiving signals that can be used as a basis for determining current location for the antenna. For example, cellular signals received by network interface 280 can be used to determine location information based on triangulation of signals received from multiple cell towers.

The motor controller 290 can move the antenna to point in a desired direction. The motor controller 290 can receive signals from the ACU 220 instructing the motor controller 290 to move the antenna. The motor controller 290 can control electromechanical components of the antenna that move the antenna in response to the heading information, the azimuth angle, and the elevation angle determined by the ACU 220. The coordinated movements of the first antenna 110*a* and the second antenna 110*b* to point at each other provides for optimized communications between the first and second user terminals 125*a* and 125*b*. For example, the motor controller 290 of the first user terminal 125*a* can maintain a heading of the first antenna 110*a* to the second antenna 110*b*, the azimuth angle, and the elevation angle needed to allow a signal to bounce off of the troposphere 105 to establish troposcatter communications 130 between the first and second antennas 110*a* and 110*b*. Likewise, the motor controller 290 of the second user terminal 125*b* can maintain the heading of the second antenna 110*b* to the first antenna 110*a*, the azimuth angle, and the elevation angle needed to allow a signal to bounce off of the troposphere 105 to establish the troposcatter communications 130 between the first and second antennas 110*a* and 110*b*.

The motor controller 290 can change a direction of pointing of the antenna associated with the user terminal 125. The motor controller 290 can compensate for inertial information determined by the INU 292. The motor controller 290 can compensate for any inertial forces that may move the antenna out of an optimal pointing direction.

Figure 3:
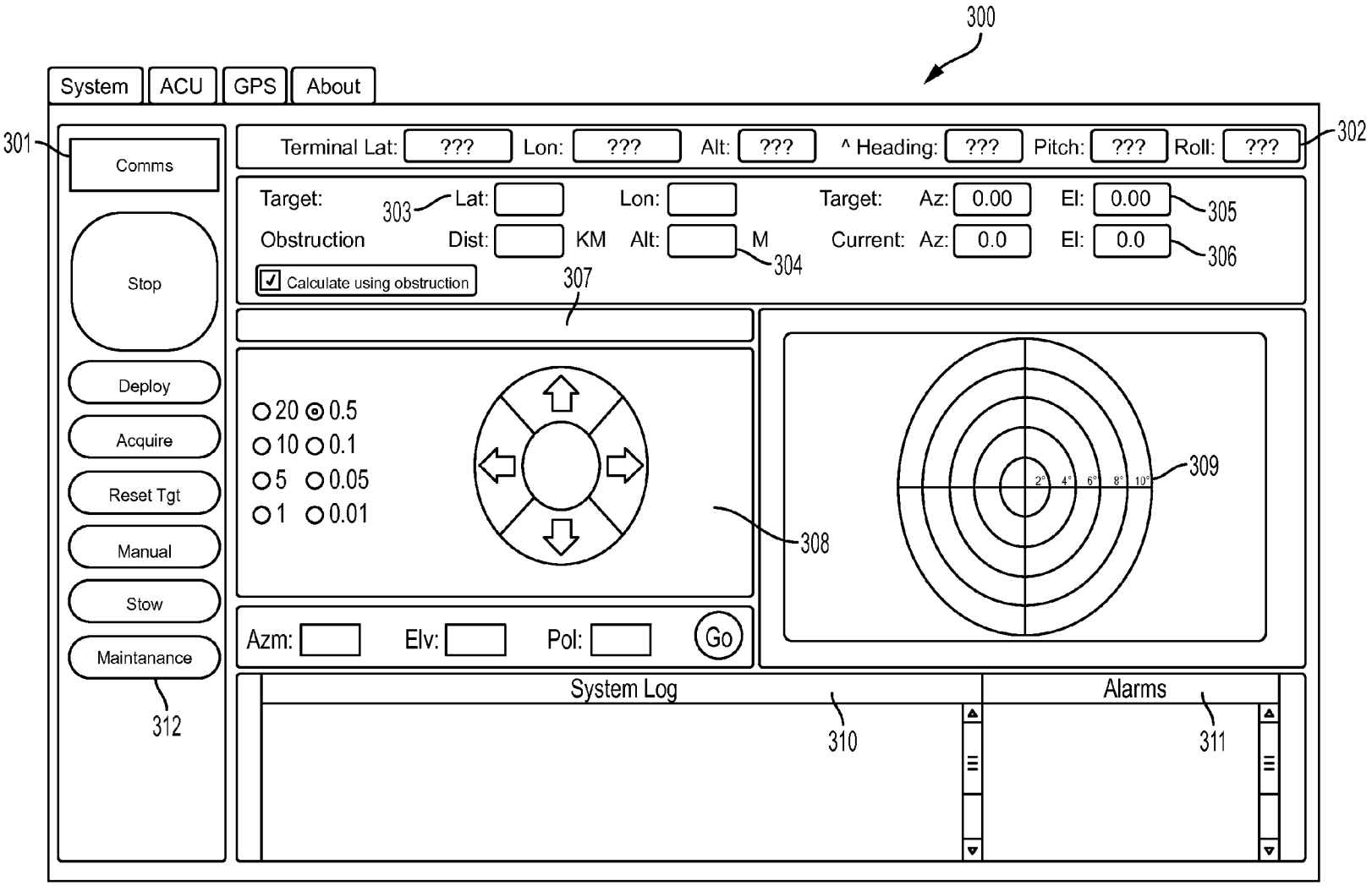
FIG. 3 illustrates an example graphic user interface with which an operator can operate a user terminal, according to one or more embodiments.

FIG. 3 illustrates an example graphic user interface 300 with which an operator can operate a user terminal 125, according to one or more embodiments. The graphic user interface (GUI) 300 can include various boxes through which the operator can view values, enter values, and initiate operations related to pointing of the antenna and operating the user terminal 125. In one or more embodiments, the GUI 300 can be displayed and executed in a web browser.

The GUI 300 can include a graphic button 301 to initiate display, on user terminal 125, of a status of communications with peripheral devices, such as, for example inertial receiver 292, location receiver 294, motor controller 290, and/or any other peripheral that may be connected to the user terminal 125. The GUI 300 can further include a box 302 to display current location information of a local antenna, a current heading of the local antenna, and pitch/roll information and a box 303 to display current location information of a distant antenna. The GUI 300 can include a box 304 to display a nearest diffraction point or distance to a distant antenna and an elevation angle needed to calculate a takeoff angle for a local antenna, a box 305 to display a calculated azimuth angle and an elevation angle for a distant antenna, and a box 306 to display a current azimuth angle and elevation angle for a local antenna.

The GUI 300 can further include a box 307 to display current local antenna status information, a box 308 to display user terminal 125 manual operation controls when enabled, a box 309 to display a bulls eye graphic of a location of a calculated distant antenna and pointing of a local antenna relative to a distant antenna. Box 309 can display such information in response to an acquire button being virtually pressed. The GUI 300 can further include a box 310 to display an events log for the user terminal 125, a box 311 to display an alarms log for the user terminal 125, and a box 312 to display operations available to an operator of the user terminal 125, such as, for example stop communications, deploy, acquire information for establishing troposcatter communications 130 with a distant antenna, reset target troposcatter communications 130 with the distant antenna, toggle manual operations of the user terminal 125, stow the user terminal 125, and initiate maintenance of the user terminal 125.

Figure 4:
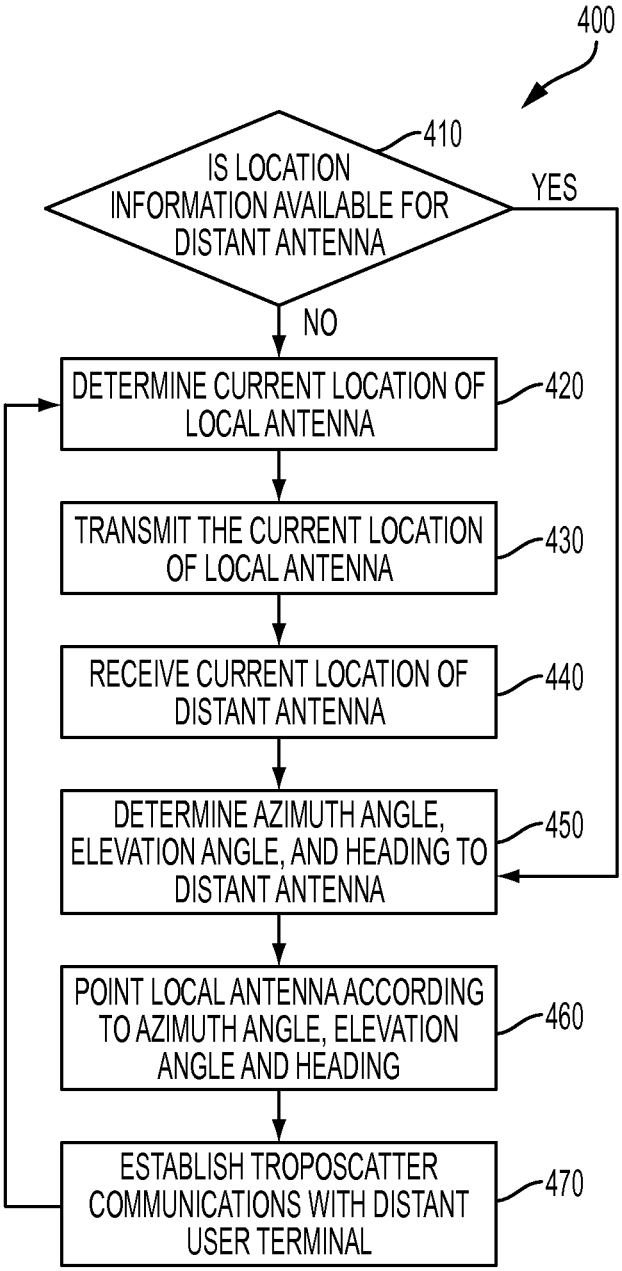
FIG. 4 illustrates an example method to point an antenna, according to one or more embodiments.

FIG. 4 illustrates an example method 400 to point an antenna, according to one or more embodiments.

The method 400 can begin at block 410. Block 410 can determine whether current location information is available at a local user terminal 125 for a distant antenna. For example, the first user terminal 125*a* can determine whether current location information is available for the second antenna 110*b*. Alternately, an operator of the user terminal 125 can manually enter a unique identifier and location information into the GUI 300. If the current location information is available at the local user terminal 125, block 410 can branch to block 450. If the current location information is not available at the local user terminal 125, block 410 can branch to block 420.

At block 420, the local user terminal 125 can determine a current location of a local antenna. For example, the first user terminal 125*a* can determine current location information for the first antenna 110*a*. The ACU 220 of the first user terminal 125*a* can read current location information from the location receiver 294, the current location information associated with the current location of the first antenna 110*a*. Block 420 can proceed to block 430.

At block 430, a local user terminal 125 can transmit a unique identifier and the current location information of a local antenna. For example, the first user terminal 125*a* can transmit the unique identifier of the first user terminal 125*a* and current location information of the first antenna 110*a*. The ACU 220 of the first user terminal 125*a* can control network interface 280 to transmit its unique identifier and current location information of the first antenna 110*a* to the second user terminal 125*b*. Block 430 can proceed to block 440.

At block 440, a local user terminal 125 can receive a unique identifier and current location information of a distant antenna. For example, the first user terminal 125*a* can receive a unique identifier of the second user terminal 125*b* and current location information of the second antenna 110*b*. The ACU 220 of the first user terminal 125*a* can control network interface 280 to receive, via the network interface 280, the unique identifier of the second user terminal 125*b* and the current location information of the second antenna 110*b*. Block 440 can proceed to block 450.

At block 450, a local user terminal 125 can determine an azimuth angle, an elevation angle, and heading for a local antenna that allows for optimized troposcatter communications 130 with a distant user terminal 125. A local user terminal 125 can use current location information of a distant antenna as a basis for determining the azimuth angle, elevation angle, and the heading. For example, the ACU 220 of the first user terminal 125*a* can determine an azimuth angle, an elevation angle, and a heading for a first antenna 110*a* that allows for optimized troposcatter communications 130 with the second user terminal 125*b*. The ACU 220 of first user terminal 125*a* can determine the azimuth angle, the elevation angle, and the heading based on current location information of the first antenna 110*a* received in block 420 and current location information of the second antenna 110*b* received in block 440. Block 450 can proceed to block 460.

At block 460, the user terminal 125 can point the antenna. The user terminal 125 can point the antenna according to the heading, the azimuth angle, and the elevation angle determined at block 450. For example, the motor controller 290 of the first user terminal 125*a* can set the heading, the azimuth angle, and the elevation angle of the first antenna 110*a* that is needed to establish optimized troposcatter communications 130 with the second antenna 110*b*.

At block 470, a local user terminal 125 can establish optimized troposcatter communications 130 with a distant user terminal 125. For example, the first user terminals 125*a* can control transmission of whatever control data is needed to setup troposcatter communications 130 with the second user terminal 125*b*. Block 470 can proceed to block 420 to allow for continuous pointing of the first and second antennas 110*a* and 110*b* to continuously optimize the troposcatter communications 130.

It should be understood that, notwithstanding the particular steps as shown in the figures, a variety of additional or different steps can be performed depending upon the embodiment, and one or more of the particular steps can be rearranged, repeated or eliminated entirely depending upon the embodiment. Also, some of the steps performed can be repeated on an ongoing or continuous basis simultaneously while other steps are performed. Furthermore, different steps can be performed by different elements or in a single element of the disclosed embodiments.

The method of this disclosure can be implemented on a programmed processor. However, the controllers, flowcharts, and modules may also be implemented on a general purpose or special purpose computer, a programmed microprocessor or microcontroller and peripheral integrated circuit elements, an integrated circuit, a hardware electronic or logic circuit such as a discrete element circuit, a programmable logic device, or the like. In general, any device on which resides a finite state machine capable of implementing the flowcharts shown in the figures may be used to implement the processor functions of this disclosure.

While this disclosure has been described with specific embodiments thereof, it is evident that many alternatives, modifications, and variations will be apparent to those skilled in the art. For example, various components of the embodiments may be interchanged, added, or substituted in the other embodiments. Also, all of the elements of each figure are not necessary for operation of the disclosed embodiments. For example, one of ordinary skill in the art of the disclosed embodiments would be enabled to make and use the teachings of the disclosure by simply employing the elements of the independent claims. Accordingly, embodiments of the disclosure as set forth herein are intended to be illustrative, not limiting. Various changes may be made without departing from the spirit and scope of the disclosure.

In this document, relational terms such as "first," "second," and the like may be used solely to distinguish one entity or action from another entity or action without necessarily requiring or implying any actual such relationship or order between such entities or actions. The phrase "at least one of" followed by a list is defined to mean one, some, or all, but not necessarily all of, the elements in the list. The terms "comprises," "comprising," or any other variation thereof, are intended to cover a non-exclusive inclusion, such that a process, method, article, or apparatus that comprises a list of elements does not include only those elements but may include other elements not expressly listed or inherent to such process, method, article, or apparatus. An element proceeded by "a," "an," or the like does not, without more constraints, preclude the existence of additional identical elements in the process, method, article, or apparatus that comprises the element. Also, the term "another" is defined as at least a second or more. The terms "including," "having," and the like, as used herein, are defined as "comprising." Furthermore, the background section is written as the inventor's own understanding of the context of some embodiments at the time of filing and includes the inventor's own recognition of any problems with existing technologies and/or problems experienced in the inventor's own work.

We claim:

1. A troposcatter terminal, comprising:

a location receiver configured to receive first current location information associated with a local troposcatter antenna;

a network interface configured to receive second current location information associated with a distant troposcatter antenna;

an antenna control unit configured to determine a heading from the local troposcatter antenna to the distant troposcatter antenna, an azimuth angle for the local troposcatter antenna, and an elevation angle for the local troposcatter antenna, the heading, the azimuth angle, and the elevation angle based on the first location information and the second location information; and a motor controller configured to point the local troposcatter antenna according to the heading, the azimuth angle, and the elevation angle determined by the antenna control unit to establish troposcatter communications between the local troposcatter antenna and the distant troposcatter antenna.

2. The troposcatter terminal according to claim 1, wherein the location receiver is a Global Positioning System (GPS) receiver.

3. The troposcatter terminal according to claim 1, wherein the location receiver is an acoustic positioning receiver.

4. The troposcatter terminal according to claim 1, further comprising an inertial navigation unit to read roll, pitch, and yaw associated with the local troposcatter antenna.

5. The troposcatter terminal according to claim 4, wherein the motor controller compensates for the roll, pitch, and yaw read by the inertial navigation unit.

6. The troposcatter terminal according to claim 1, wherein the network interface is a cubesat interface.

7. The troposcatter terminal according to claim 1, wherein the network interface is a cellular interface.

8. The troposcatter terminal according to claim 1, wherein the network interface is an Ultra High Frequency (UHF)/Very High Frequency (VHF) interface.

9. The troposcatter terminal according to claim 1, further comprising a graphic user interface to display pointing information associated with the local troposcatter antenna.

10. The troposcatter terminal according to claim 1, wherein the troposcatter terminal is identified by a unique identifier.

11. A method to establish troposcatter communications, comprising:

receiving, with a location receiver, first current location information associated with a local troposcatter antenna;

receiving, with a network interface, second current location information associated with a distant troposcatter antenna;

determining, with an antenna control unit, a heading from the local troposcatter antenna to the distant troposcatter antenna, an azimuth angle for the local troposcatter antenna, and an elevation angle for the local troposcatter antenna, the heading, the azimuth angle, and the elevation angle based on the first location information and the second location information; and pointing, with a motor controller, the local troposcatter antenna according to the heading, the azimuth angle, and the elevation angle to establish the troposcatter communications between the local troposcatter antenna and the distant troposcatter antenna.

12. The method to establish troposcatter communications according to claim 11, wherein the location receiver is a Global Positioning System (GPS) receiver.

13. The method to establish troposcatter communications according to claim 11, wherein the location receiver is an acoustic positioning receiver.

14. The method to establish troposcatter communications according to claim 11, further comprising reading, with an inertial navigation unit, roll, pitch, and yaw associated with the local troposcatter antenna.

15. The method to establish troposcatter communications according to claim 14, further comprising stabilizing, with the motor controller, the local troposcatter antenna according to the roll, pitch, and yaw read by the inertial navigation unit.

16. The method to establish troposcatter communications according to claim 11, wherein the network interface is a cubesat interface.

17. The method to establish troposcatter communications according to claim 11, wherein the network interface is a cellular interface.

18. The method to establish troposcatter communications according to claim 11, wherein the network interface is an Ultra High Frequency (UHF)/Very High Frequency (VHF) interface.

19. The method to establish troposcatter communications according to claim 11, further comprising displaying, with a graphic user interface, pointing information associated with the local troposcatter antenna.

20. The method to establish troposcatter communications according to claim 11, further comprising identifying a troposcatter terminal, associated with the local troposcatter antenna, by a unique identifier.

* * * * *